US006653585B2

(12) United States Patent
Chun

(10) Patent No.: US 6,653,585 B2
(45) Date of Patent: Nov. 25, 2003

(54) KEY SWITCH

(75) Inventor: Gyu Chul Chun, Iksan (KR)

(73) Assignee: SMK Korea Co., Ltd., Iksan (KR)

( * ) Notice: Subject to any disclaimer, the term of this patent is extended or adjusted under 35 U.S.C. 154(b) by 0 days.

(21) Appl. No.: 10/231,775

(22) Filed: Aug. 28, 2002

(65) Prior Publication Data

US 2003/0042123 A1 Mar. 6, 2003

(30) Foreign Application Priority Data

Aug. 31, 2001 (KR) ..... 10-2001-53162

(51) Int. Cl.[7] ..... H01H 9/20
(52) U.S. Cl. ..... 200/344; 200/341
(58) Field of Search ..... 200/314, 329, 200/337, 341–344, 5 A, 511, 518, 520, 521, 6 BB, 6 C

(56) References Cited

U.S. PATENT DOCUMENTS

| | | | | |
|---|---|---|---|---|
| 5,488,210 A | * | 1/1996 | Shigetaka et al. | 200/344 |
| 5,779,030 A | * | 7/1998 | Ikegami et al. | 200/344 |
| 6,150,624 A | * | 11/2000 | Yao | 200/344 |
| 6,172,868 B1 | * | 1/2001 | Oura | 361/680 |
| 6,297,461 B1 | * | 10/2001 | Kamishima | 200/5 A |
| 6,444,933 B1 | * | 9/2002 | Chun | 200/344 |
| 6,545,238 B2 | * | 4/2003 | Hsu et al. | 200/344 |

FOREIGN PATENT DOCUMENTS

| | | | |
|---|---|---|---|
| JP | 6-36651 | * | 6/1994 |
| JP | 8279316 A2 | | 10/1996 |

* cited by examiner

*Primary Examiner*—Lincoln Donovan
*Assistant Examiner*—Lisa Klaus
(74) *Attorney, Agent, or Firm*—Greenlee, Winner and Sullivan, P.C.

(57) ABSTRACT

A key switch adapted to raise or lower a key top according to need is disclosed. The key switch includes a key top, a link assembly comprised of two link members and operatively connected to the key top, which is retracted by a pressure on the key top and extended by release of the pressure and which has an elastic member at its lower end, an FPC placed on a frame of a keyboard to recognize pressing of the key top, and a plate movably placed on the FPC, to which a lower end of one of the link members is connected, and which has an elastic supporting member being in contact with the elastic member of the link assembly. When the key top is pressed down, the link assembly is retracted while compressing the elastic member of the link assembly and the elastic supporting member of the plate. When the link assembly is further lowered, an elastic resistance of the elastic supporting member is suddenly increased, and thus the elastic member of the first link member is suddenly bent and quickly lowered, thereby affording a click sense to a user and enabling the bent portion of the elastic member to press the FPC.

13 Claims, 8 Drawing Sheets

KEY SWITCH

CROSS-REFERENCE TO RELATED APPLICATIONS

This application takes priority from Korean Application No. 10-2001-0053162 filed Aug. 31, 2001.

BACKGROUND OF THE INVENTION

1. Field of the Invention

The present invention relates to a key switch for use in an input device such as a keyboard of a PC (Personal Computer), and more particularly to a key switch which is intended to realize a compact and slim keyboard and to provide a high keystroke and a resilient click sense to a user by its simple configuration, thereby affording a reliable key-input performance. The present invention also relates to a key switch adapted to be produced by a simple manufacturing process.

2. Description of the Prior Art

These days, key tops have been thinned and flattened to comply with needs for compact keyboards, and a high keystroke and a reliable clear click sense are required to enhance ease and reliability of a key-input operation. There are proposed various key switches for use in such keyboards.

For example, Japanese Patent Laid-Open No. 8-279316 discloses a key switch described hereinafter.

A guide assembly for guiding an up-and-down motion of a key top is comprised of first and second link members. The first and second link members are hingedly connected in an "U" shape to guide the vertical motion of the key top. The first link member is provided at its end with a spring member having a switch-actuating portion, and a support plate is provided with a slanted protrusion having an inclined face. As the spring member is slid on the inclined face of the slanted protrusion, a resistance to movement of the spring member is gradually increased. When the spring member is slid beyond the peak of the slanted protrusion and then comes into contact with a switch seat, the resistance to movement of the spring member is suddenly reduced, thereby affording a click sense to a user. At the same time, the switch actuation portion of the spring member presses a switching portion.

Since the key switch is adapted to employ the guide assembly comprised of a link mechanism rather than a rubber spring, it is possible to realize a compact and slim keyboard. Furthermore, since the switch-actuating portion of the spring member is slid beyond the slanted protrusion, thereby providing a variation of the resistance, a user can feel a clear click sense.

However, there is a limit to realization of a slim keyboard by such a known link mechanism. More specifically, it is impossible to reduce a thickness of a keyboard to a value not greater than a stroke length of the key top because a click sense (or a touch sense) becomes poor owing to reduction of a stroke length of the key top. Accordingly, it is necessary to reduce thickness of components other than a stroke length of the key top. In addition, it is required to reduce a thickness of a keyboard to a value not greater than a stroke length and for a user to have the keyboard in his custody when the keyboard is not used.

In addition, as notebook computers and PDAs are extensively distributed, more compact key switches are required.

SUMMARY OF THE INVENTION

Accordingly, the present invention has been made keeping in mind the above problems occurring in the prior art, and an object of the present invention is to provide a key switch which is adapted to raise or lower a key top by its stroke length, according to whether a keyboard is used or not, thereby affording a favorable click sense and a reduction of thickness of a notebook or a PDA.

In order to accomplish the above object, the present invention provides a key switch comprising: a key top which is pressed down by a user's finger; a link assembly comprised of first and second link members, which is lowered by pressure of the key top and is raised together with the key top by release on the pressure of the key top, the first link member including two legs pivotably connected to the key top at their upper ends, and a strip-shaped elastic member positioned between the both legs which is adapted to raise the first link member by application of an external force, the second link member including two legs pivotably connected to the key top at their upper ends and pivotably connected to a frame of a keyboard at their lower ends, the first and second link members being provided at their center portions with a hinge means comprised of a hinge protrusion and a hinge hole to allow the link assembly to be extended and retracted; an FPC (Flexible Printed Circuit) placed on the frame of the keyboard, which enables a character printed on the key top to be recognized by a contact between the link assembly and the FPC when the link assembly is lowered; and a plate placed on the FPC to be moved with respect to the frame of the keyboard, to which lower ends of the legs of the first link member are pivotably connected, and which is provided with an elastic supporting member for applying elasticity to the elastic member of the first link member when the plate is moved in a direction; whereby, when the key top is applied with pressure, the link assembly is retracted and lowered while overcoming an elasticity of the elastic supporting member of the plate, and when the link assembly is further lowered, an elastic resistance of the elastic supporting member is suddenly increased, and thus the elastic member of the first link member is suddenly bent into a bow shape and quickly lowered, thereby affording a click sense to a user and enabling the bent portion of the elastic member to press the FPC to recognize a signal corresponding to the key top.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

This invention will be described in further detail by way of example with reference to the accompanying drawings.

Figure 1:
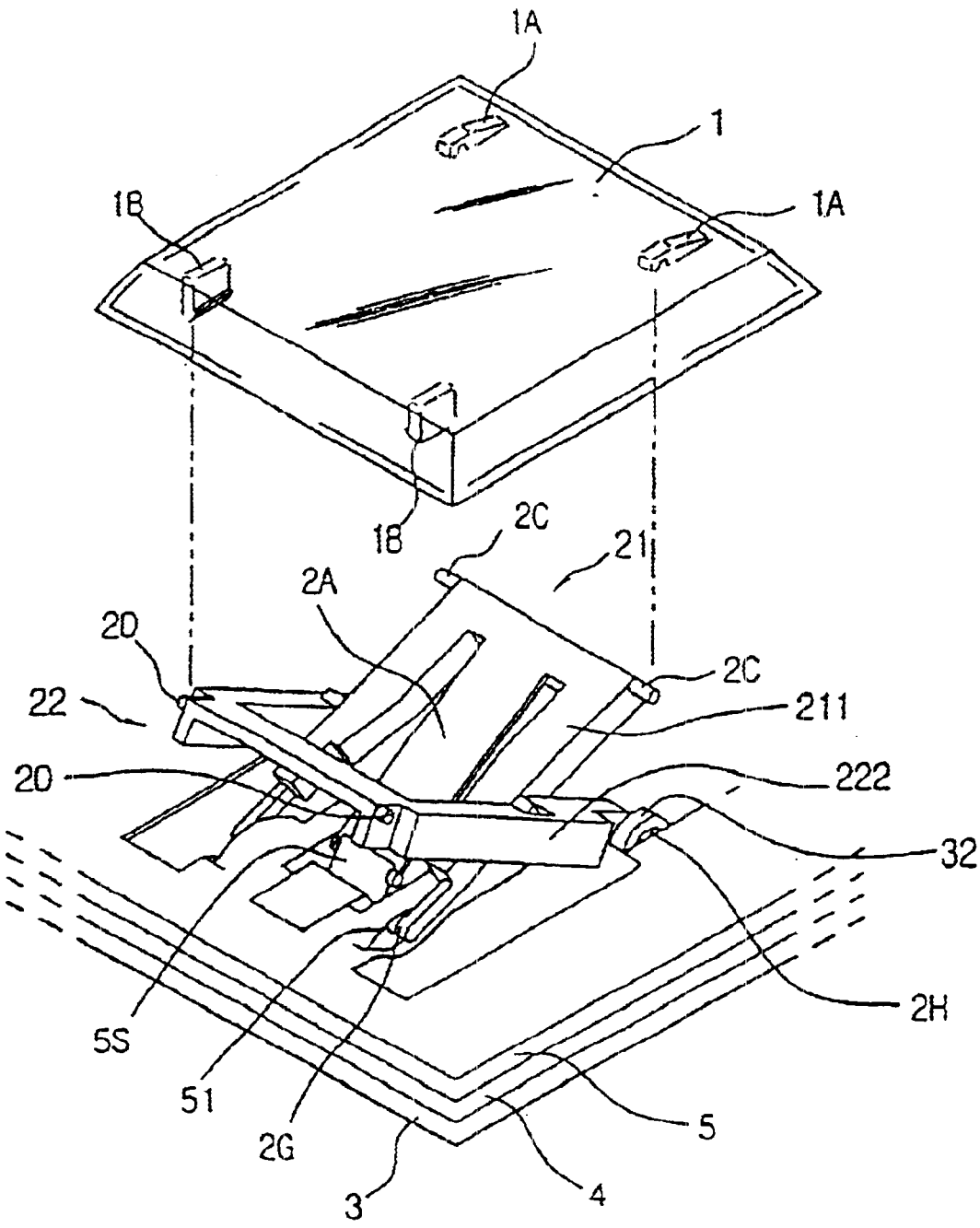
FIG. 1 is a perspective view of a key switch according to an embodiment of the present invention, in which a key top is removed therefrom to clearly show its internal structure.
Figure 2:
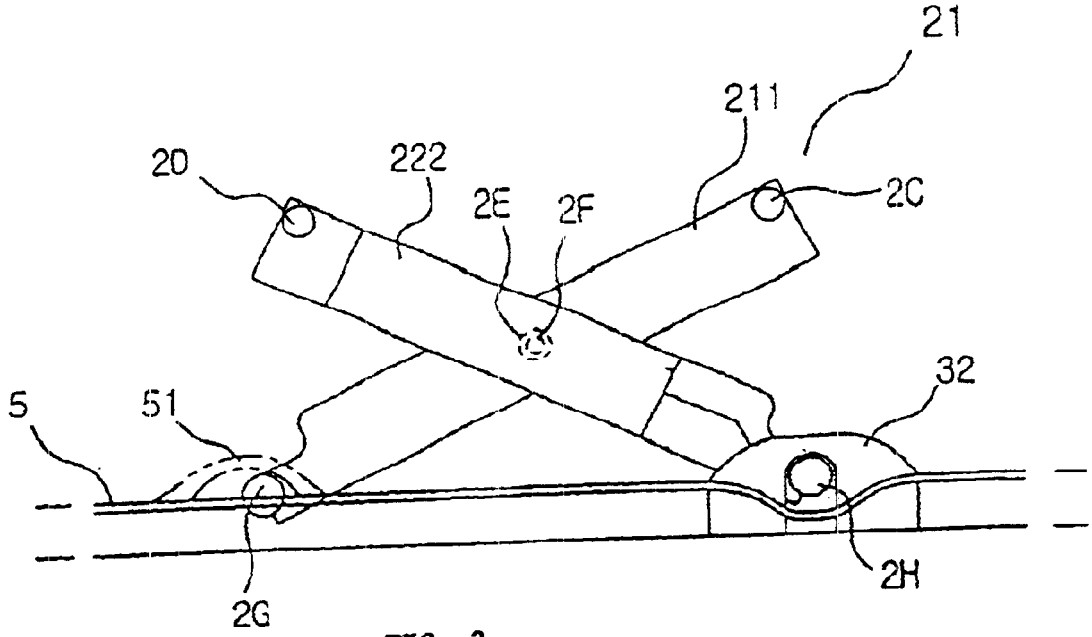
FIG. 2 is a side cross-sectional view of first and second link members according to the present invention.

FIG. 1 is a perspective view of a key switch according to the present invention, and FIG. 2 is a side cross-sectional view showing links, which are normally positioned in an unpressed state.

As shown in FIGS. 1 and 2, the key switch of the present invention comprises a key top 1, a link assembly 2, a FPC (Flexible Printed circuit) 4 and a frame 3, which are positioned in this order from top to bottom.

The key top 1 is mounted on an upper surface of a keyboard, and is printed at its upper surface with numeric characters (0, 1, 2, 3, - - - ), literal characters (a, b, c, - - - , @, #, - - - ) or functional indications (Esc, Ctrl, Alt, Home, PgUp, - - - ). The key top 1 is pressed down by a user's finger to send a key signal to a PC, and then resiliently raised to its normal position by elasticity of the link assembly 2. The key top 1 is generally formed into an approximately square roof shape, and is made of plastic material. Among various key tops 1, key tops such as Space keys, Enter keys, Shift keys and the like are formed in elongated rectangular shapes.

The link assembly 2 serves to guide an up-and-down motion of the key top 1, and is adapted to be retracted by pressure of the key top 1 and then extended to its normal position by a leaf spring, thereby providing a click sense to a user.

The plate 5 is laterally slid, and serves to reduce a full thickness of a keyboard by lowering a height of the link assembly 2 when the keyboard is folded or when an LCD cover of a notebook computer is closed. The plate 5 is provided with a supporting spring 5S, which applies elasticity to a leaf spring 2A.

The supporting spring 5S is required to push the leaf spring 2A with a proper elasticity to provide a good click sense. To this end, the supporting spring 5S must be formed to have a certain or larger size. Accordingly, it is preferable that the FPC 4 and the frame 3 are formed with grooves, and the supporting spring 5S is bent into an approximate "U" shape and received into the grooves of the FPC 4 and the frame 3.

The FPC 4 is comprised of a matrix circuit, which is adapted to recognize a character printed on the associated key top 1 when its contact point comes into contact with a lower contact point of the leaf spring 2A by lowering motion of the key top 1.

The frame 3 includes a coupling mechanism for coupling the link assembly 2 thereto, and supports the link assembly 2 and thus the key top 1.

The above-mentioned coupling mechanism and components of the link assembly 2 will now be described.

The key top 1 is provided at its lower surface with a pair of hooks 1A and a pair of grooves 1B, which are intended to couple the link assembly 2 thereto.

The hooks 1A are formed into semicircular shapes, into which pins 2C of a first link member 21 are fitted, and which serve to pivotably support the pins.

The grooves 1B are linear guides, into which pins 2D of a second link member 22 are slidably received, and which serve to linearly guide movement of the pins 2D.

In this embodiment, although the hooks 1A are shown to be positioned at a rear side of the lower surface of the key top 1 and the grooves 1B are shown to be positioned at a front side of the lower surface of the key top 1 in the drawing, positions of the hooks 1A and the grooves 1B are properly varied depending on the positions of the pins of the link assembly 2. Alternatively, the coupling mechanism may be configured in such a way that the hooks are provided at the link assembly 2 and the pins are provided at the key top 1.

The frame 3 is provided with a pair of brackets for coupling the link assembly 2 thereto. More specifically, the frame 3 is provided with the pair of brackets 32 having holes into which protrusions 2H formed at both sides of a lower side of the second link member 22 are inserted. The brackets 32 function to rotatably support the protrusions 2H of the second link member 22.

The configuration of the brackets and the protrusions may be varied such that the brackets are provided at the second link member 22 and the protrusions are provided at the frame 3.

Components of the link assembly 2 and their coupling structure will now described.

As shown in FIGS. 1 and 2 and as described above, the link assembly 2 comprises an inner link member and an outer link member, which are connected to each other into the shape of scissors. In the specification, the inner link member having the leaf spring is referred to as the first link member 21, and the outer link member is referred to as the second link member 22, for the sake of convenience.

The leaf spring 2A is positioned between a pair of legs 211 of the first link member 21. The leaf spring 2A is a plate-shaped spring, which is bent into an arched form to provide a click sense when the leaf spring 2A is applied with a certain pressure. The arched leaf spring 2A comes into contact with a contact point of the FPC 4 at its lower bent portion, thereby enabling a PC to recognize the character on the associated key top 1.

In this embodiment, although the leaf spring 2A is molded together with the pair of legs 211, the present invention is not limited to this integral molding. For example, the leaf spring 2A may be separately made of metal material, and joined to the first link member by an insert molding process. Alternatively, the first link member may be made of metal material.

The first link member 21 is provided at both ends of its upper side with the pins 2C, which are pivotably engaged with the hooks 1A of the key top 1, thereby allowing the key top 1 to be coupled to the link assembly 2.

The second link member 22 is also provided at both ends of its upper side with the pins 2D, which are slidably engaged with the grooves 1B of the key top 1, thereby allowing the key top 1 to be coupled to the link assembly 2.

Figure 3:
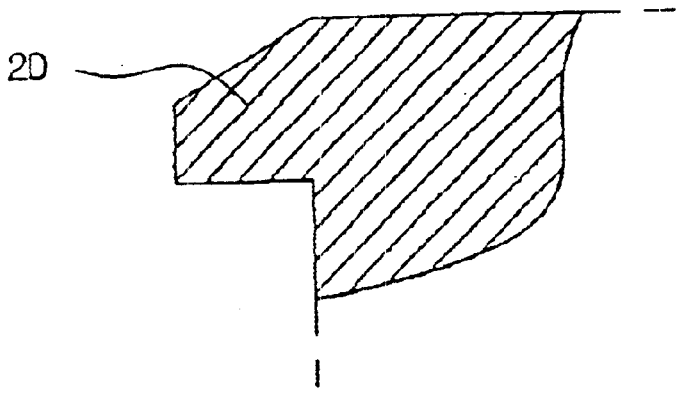
FIG. 3 is a cross-sectional view of a pin provided at the link member according to the present invention.

Each of the pin 2D of the second link member 22 is preferably provided at its upper side with a slanted surface (see FIG. 3).

The legs 211 of the first link member 21 are provided at their lower ends with first protrusions 2G. The protrusions 2G are inserted into holes of retainers 51 formed at the plate 5. Each of the holes of the retainers 51 are formed into an elliptical or an elongated circular shape to allow the protrusion 2G to be slid and rotated thereby. The retainers 51 are formed at the plate 5 such that their centers are positioned below the plate 5. Accordingly, the configurations of the retainers 51 enable an overall height of the link assembly 2 to be lowered.

The legs 222 of the second link member 22 are provided at their lower end with second protrusions 2H, which are inserted into the holes of the brackets 32 formed at the frame 3. The holes of the brackets 32 are formed such that their shapes are equal to those of the protrusions 2H of the second link member 22 to snugly and rotatably support the protrusions 2H.

Figure 4:
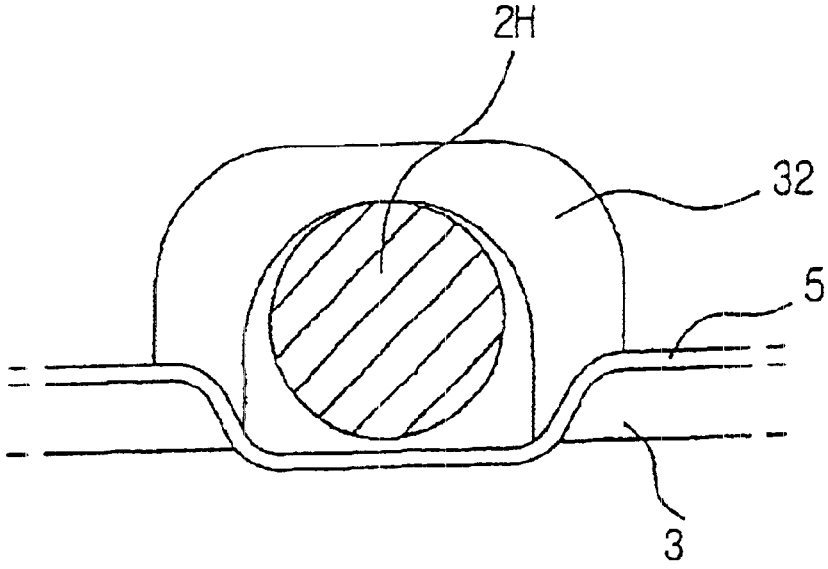
FIG. 4 is a view showing a connection between a frame and the link member according to the present invention.

In the coupling of the brackets 32 and the protrusions 2H, it is preferable that the plate 5 is positioned under the protrusions 2H to support the protrusions 2H. The brackets 32 are formed at the frame 3. In the formation of the brackets 32, it is difficult to dispose the brackets 32 such that lower portions of the brackets 32 are positioned to be lower than an upper surface of the frame 3. That is, it is difficult to fabricate the brackets 32 such that lower portions of the protrusions 2H are positioned below an upper surface of the frame 3. Accordingly, it is possible to dispose upper surfaces of the protrusions 2H below an upper surface of the frame 3 by causing the plate 5 to be disposed under the protrusions. Hence, since axes of the protrusions are positioned to be close to a lower surface of the frame 3, an overall height of the link assembly is lowered and thus a keyboard employing the link assembly can become thin (see FIG. 4).

The first and second link members 21 and 22 are provided at their crossed portions with hinge protrusions 2E and hinge holes 2F for pivotably supporting the link assembly 2. In this embodiment, the first link member 21 is provided with the hinge protrusions 2E, and the second link member 22 is provided with the hinge holes 2F. As opposed to the above configuration, it is also possible to provide the first link member 21 with the hinge holes and to provide the second link member 22 with the protrusions. The hinge protrusions 2E and the hinge holes 2F enable the first and second link members 21 and 22 to be extended and retracted.

Functions of the key switch according to the present invention will now be described.

A function for lowering the link assembly 2 when a keyboard is folded or a computer cover is closed is first described.

Figure 6:
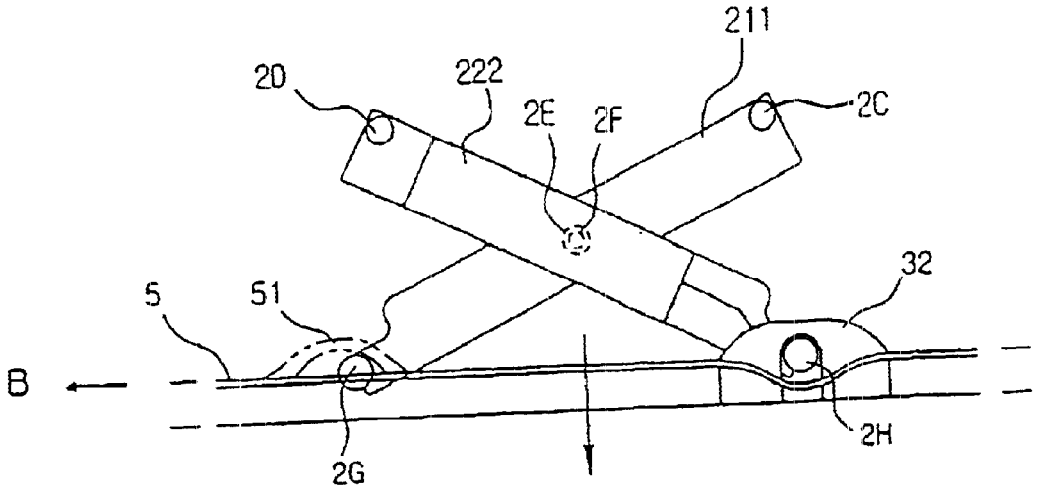
FIG. 6 is a side cross-sectional view showing a lowering motion of the first and second link members according to the present invention when a keyboard is folded or a computer cover is closed.

When a keyboard is folded or a computer cover is closed from the position shown in FIG. 2, the plate 5 is moved in the direction of arrow "B" in FIG. 6. Therefore, the retainers 51 are also moved in the direction of arrow "B" while pulling the protrusions 2G formed at lower ends of the first link member 21 in the direction of arrow "B". As the protrusions 2G are moved in the direction of arrow "B", the first and second link members 21 and 22 are retracted downwardly, thereby allowing the overall link assembly 2 to be lowered.

It is preferable to set dimensions of the associated components such that the leaf spring 2A is not deformed or is very slightly deformed when the link assembly 2 is retracted to its lowest position. By the setting of dimensions of the components, it is possible to prevent permanent deformation of the components, thereby providing a long service life.

Figure 5A:
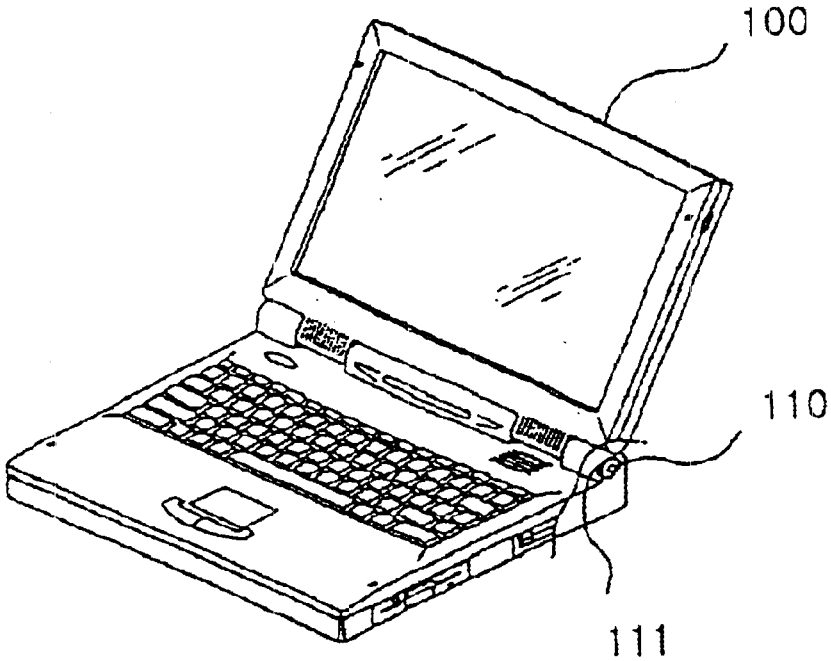
FIGS. 5A and 5B are perspective views showing a movement of a plate according to the present invention.
Figure 5B:
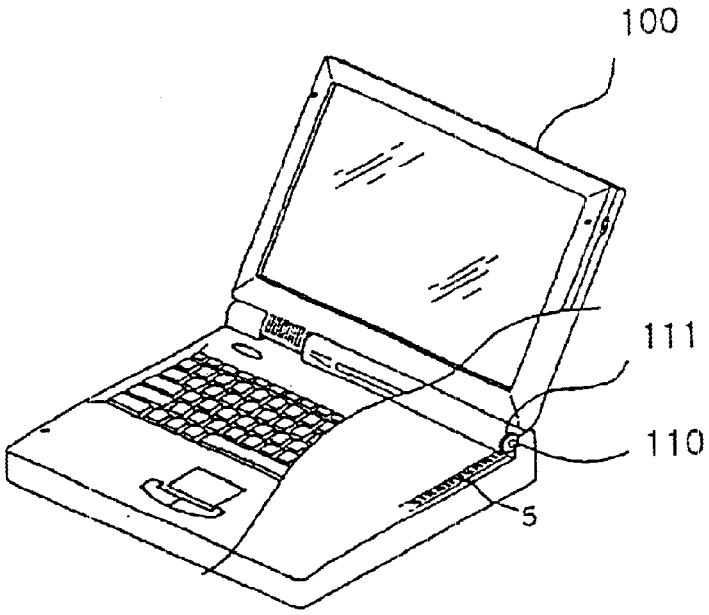

The linear movement of the plate 5 is achieved by conversion of rotational movement of a cover of a notebook computer or a PDA. More specifically, as shown in FIGS. 5A and 5B, a shaft 110 connecting the cover 100 and a keyboard is provided with a toothed cam 111 coupled thereto, and the plate is provided with tooth holes corresponding to the teeth of the toothed cam. Accordingly, as the cover 100 is opened and closed, the toothed cam 111 is rotated to move the plate 5 linearly.

Figure 7:
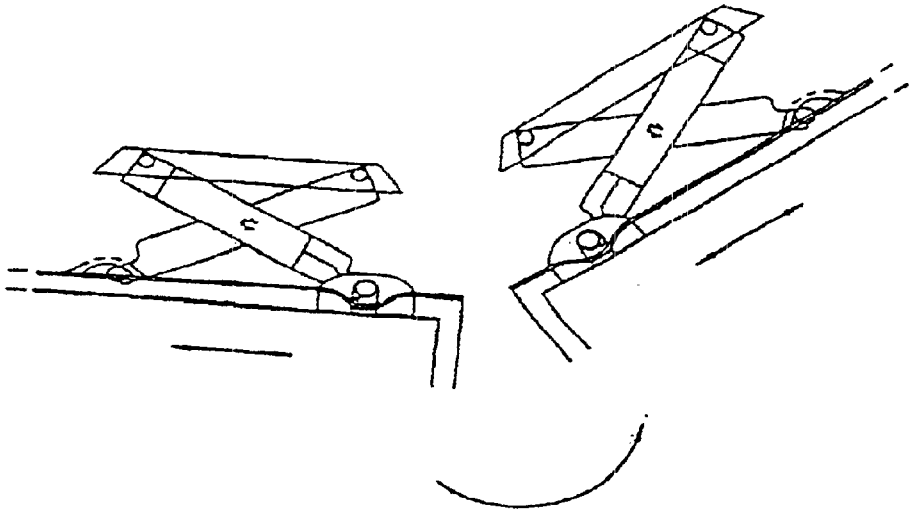
FIG. 7 is a schematic view showing a movement of the plate according to the present invention when a keyboard is folded or unfolded.

In a case of a folding type of keyboard, when a folded keyboard is unfolded, both half plates 5 come into collision with each other at their facing ends and thus are pushed outwardly with respect to the underlying frame 3. When the unfolded keyboard is folded, both the halfplates 5 are pulled to each other and thus moved inwardly (see FIG. 7).

Next, a function for raising the link assembly 2 when a keyboard is unfolded or a computer cover is opened is described.

Figure 8:
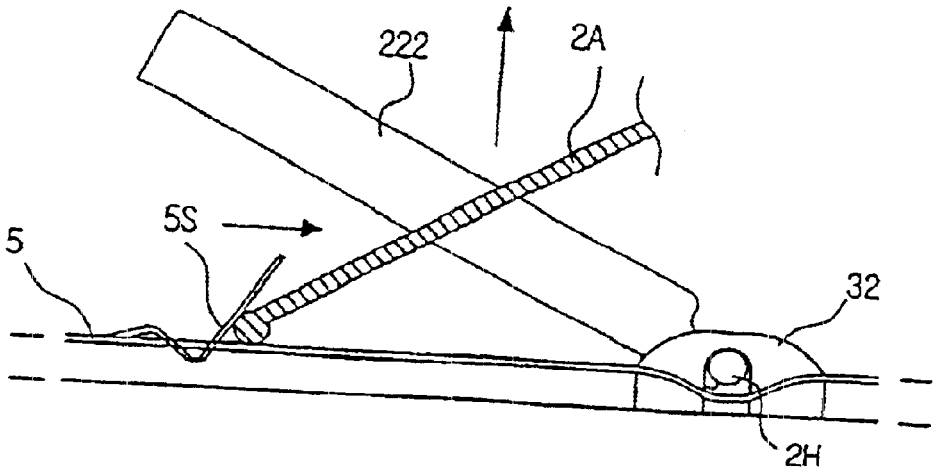
FIG. 8 is a schematic view showing a rising movement of the link members by a motion of the plate according to the present invention.

As shown in FIG. 8, when a keyboard is unfolded or a computer cover is opened, the plate 5 and the supporting spring 5S are moved in the direction of a rightward solid arrow. Accordingly, the supporting spring 5S pushes the leaf spring 2A. At this point, since a hinge point of the first and second link members 21 and 22 is positioned on the leaf spring 2A, pushing force of the supporting spring 5S is converted into raising force of the link assembly 2, resulting in raising of the key top 1.

An operation accompanied by a keystroke will now be described.

Figure 9:
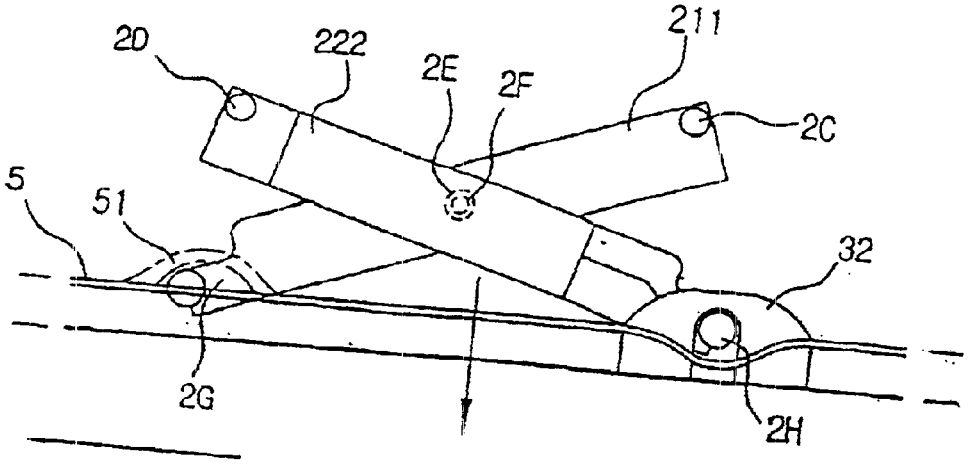
FIG. 9 is a side cross-sectional view showing a raising motion of the first and second link members according to the present invention when a key top is lowered.

When the key top 1 is pressed down by a user's finger, the key top 1 is lowered against restoring force of the supporting spring 5S from the position shown in FIG. 2. At this point, the first link member 21 of the link assembly 2 is rotated in a direction about its first protrusions 2G, and at the same time the hinge protrusions 2E of the first link member 21 are lowered. On the other hand, the second link member 22 of the link assembly 2 is rotated in the direction opposite to the rotating direction of the first link member 21 about its second protrusions 2H. By the opposite rotations of the first and second link members 21 and 22, the link assembly 2 is retracted downwardly. As the link assembly 2 is retracted downwardly, the hinge protrusion 2E of the first link member 21 is lowered and the first protrusions 2G of the first link member 21 are pushed leftward. Therefore, the first protrusions 2G are moved leftward along the elongated hole of the retainer 51 of the plate 5 (see FIG. 9).

As the first protrusions 2G are moved leftward, the leaf spring 2A is applied with compression force. The leaf spring 2A moves leftward while overcoming the elasticity of the supporting spring 5S.

During the lowering movement of the key top 1, the key top 1 is subjected to a raising force by the elasticity of the supporting spring 5S.

Figure 10:
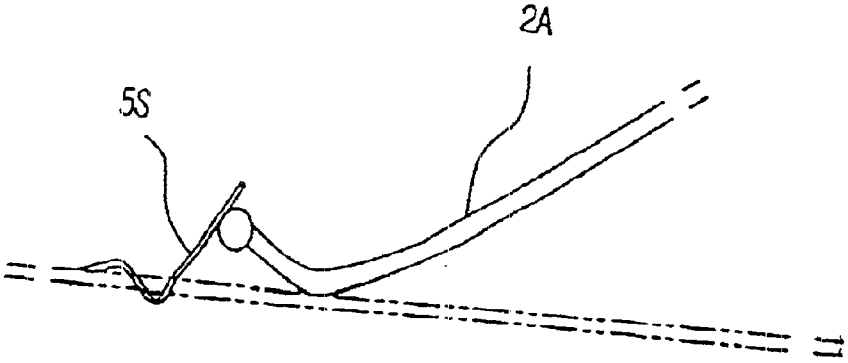
FIG. 10 is a side view showing a leaf spring according to the present invention, which presses an FPC by a lowering motion of the key top.

As the key top 1 is further pressed downwardly, the leaf spring 2A is subjected to strong compression force by the supporting spring 5S. Hence, the key top 1 is suddenly applied with high load. When the compression force applied to the leaf spring 2A becomes higher than a critical value, the leaf spring 2A is bent into a bow-like shape and is suddenly lowered, as shown in FIG. 10.

Thanks to the elastic bending deformation of the leaf spring 2A, a user can feel a definite click sense.

Furthermore, a lower bent portion of the leaf spring 2A presses a contact point of the underlying FPC 4 to enable the character printed on the associated key top 1 to be recognized.

Figure 11A:
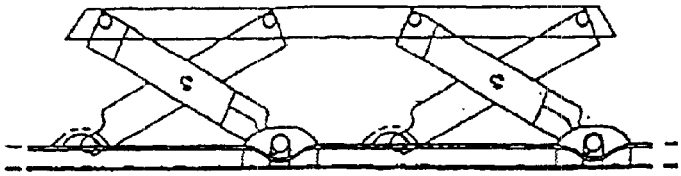
FIGS. 11A and 11B are side views showing key tops to which a plurality of link assemblies according to the present invention are applied.
Figure 11B:
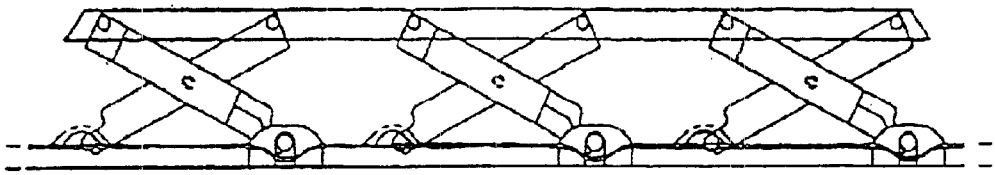

The present invention should not be limited to the above embodiment. For example, a longer key having a length several times a common key maybe applied with the corresponding number of link assemblies 2, so that a pressing force applied to the key top is evenly distributed throughout the key top even if any point of the key top is pressed down, as shown in FIGS. 11A and 11B.

Figure 12:
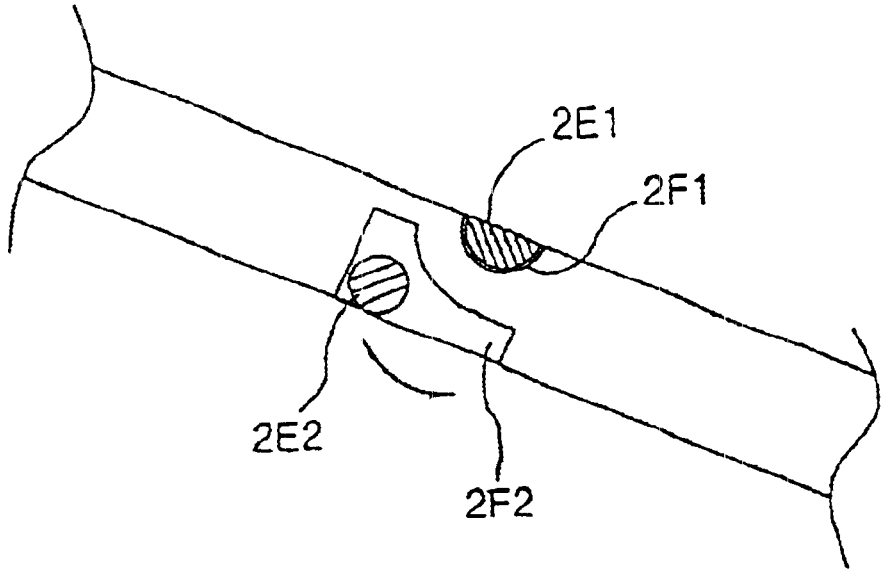
FIG. 12 is a side view of link members provided with another hinge mechanism according to the present invention.

Furthermore, the first and second link members 21 and 22 of the link assembly 2 may have another hinge mechanism in which the first and second link members 21 and 22 are rotated about main hinge protrusions 2E1 and the rotational movements of the link members are guided by auxiliary hinge protrusions 2E2, as shown in FIG. 12. Accordingly, when a computer cover is opened or a keyboard is unfolded, the link assembly 2 can be securely raised. In addition, after the key top 1 is pressed down by a user's finger, the key top 1 can be smoothly restored to its normal position. By this hinge mechanism, the link assembly 2 of the present invention can be thinned, and thus a keyboard using the link assembly 2 can be also thinned.

More specifically, as again shown in FIG. 12, the first link member 21 is provided with the main hinge protrusions 2E1 and the auxiliary hinge protrusions 2E2 while the second link member 22 is provided with a main hinge holes 2F1 and an auxiliary hinge holes 2F2 which correspond to the main and auxiliary hinge protrusions 2E1 and 2E2.

In this case, it is preferable that the main hinge holes 2F1 are formed at the highest position of the second link member 22 because it is required for the hinge axis to be positioned at a high location in order to assure secure up-and-down motion of the key top 1. Therefore, it is more preferable that the main hinge protrusions 2E1 are not completely surrounded by the main hinge holes 2F1. Due to such an incompletely surrounded state, the main hinge protrusions 2E1 may be separated from the main hinge holes 2F1. For preventing the separation of the main hinge protrusions, the second link member 22 is provided with the auxiliary hinge holes 2F2 opened down and the auxiliary hinge protrusions 2E2 are inserted into the auxiliary hinge holes 2F2. Therefore, the engagement of the auxiliary hinge protrusions 2E2 between the auxiliary hinge holes 2F2 prevents an upward separation of the first link member 21, and the engagement of the main hinge protrusions 2E1 between the main hinge holes 2F1 prevents a downward separation of the first link member 21, thereby affording stable coupling condition of the first and second link members 21 and 22 and a favorable click sense.

Furthermore, when the link assembly 2 is retracted or lowered by a pressing of the key top 1, the auxiliary hinge protrusions 2E2 of the first link member 21 are caught by upper ends of the auxiliary hinge holes 2F2 of the second link member 22 so that the link assembly 2 cannot be further lowered. On the other hand, when the link assembly 2 is extended or raised by elasticity of the supporting spring 5S and the leaf spring 2A, the auxiliary hinge protrusions 2E2 of the first link member 21 are caught by lower ends of the auxiliary hinge holes 2F2 of the second link member 22 so that the link assembly 2 cannot be further raised. Hence, the key top 1 is efficiently prevented from being separated from the link assembly 2.

Figure 13:
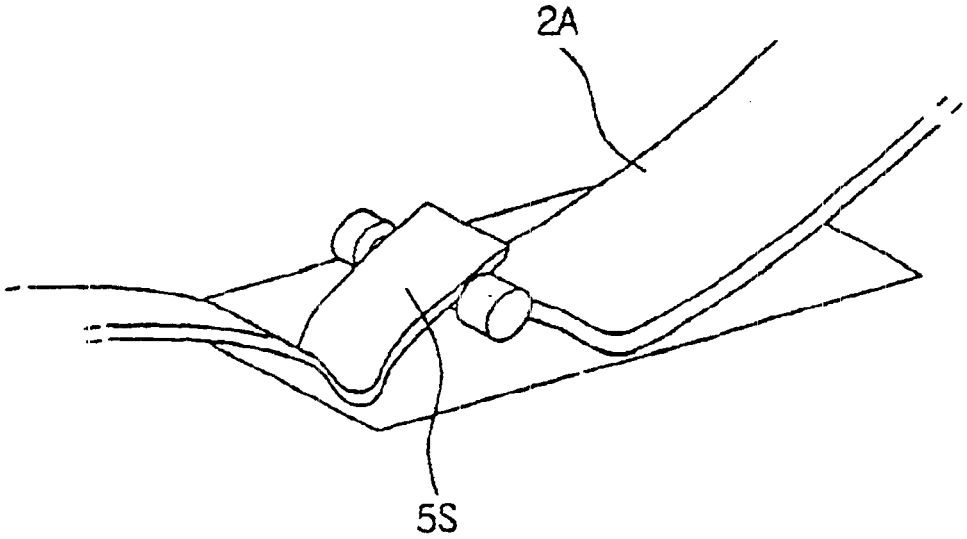
FIG. 13 is a perspective view showing a leaf spring and an elastic supporting spring according to another embodiment of the present invention.

As shown in FIG. 13, the leaf spring 2A may be provided at its end with a reception portion 2A1, which affords the stable sliding contact between the leaf spring 2A and the supporting spring 5S.

Although not shown in the drawings, the frame 3 may be provided with a hole such that the supporting spring 5S bent into a "U" shape is received into the hole at its bent portion. By the receiving hole formed at the frame 3, the supporting spring 5S can be longer within a limited space, thereby affording efficient elasticity and enhanced durability.

As described above, the present invention provides a key switch in which its key top is raised by elasticity of a leaf spring and a supporting spring, and a high repulsive force is generated by the supporting spring and the leaf spring is bent into a bow shape by pressing force of the key top when the key top is pressed down, thereby affording an excellent click sense to a user.

Since a plate placed on an FPC is provided with the supporting spring and a link member of a link assembly is connected to the plate at its lower end, the key top can be raised or lowered by the linear movement of the plate, thereby allowing the key switch to be compact and affording an excellent click sense to a user.

Furthermore, since the supporting spring is bent, the supporting spring can have a relatively long length within a limited space, thereby allowing its service life to be prolonged. The bent portion of the supporting spring is received into a recess of the plate, thereby allowing a full thickness of a keyboard using the key switch to be reduced.

In addition, since the link members of the key switch can be coupled by a dual hinge mechanism, the key top can be reliably raised or restored to the its normal position after pressing of the key top.

The leaf spring and the supporting spring can be securely achieved by providing a reception portion to the leaf spring.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A key switch comprising:

a key top which is pressed down by a user's finger;

a link assembly comprised of first and second link members, which is lowered by pressure of the key top and is raised together with the key top by release of the pressure on the key top, the first link member including two legs pivotably connected to the key top at their upper ends, and a strip-shaped elastic member positioned between the both legs which is adapted to raise the first link member by application of an external force, the second link member including two legs pivotably connected to the key top at their upper ends and pivotably connected to a frame of a keyboard at their lower ends, the first and second link members being provided at their center portions with a hinge means comprised of a hinge protrusion and a hinge hole to allow the link assembly to be extended and retracted;

an FPC (Flexible Printed Circuit) placed on the frame of the keyboard, which enables a character printed on the key top to be recognized by a contact between the link assembly and the FPC when the link assembly is lowered; and a plate placed on the FPC to be moved with respect to the frame of the keyboard, to which lower ends of the legs of the first link member are pivotably connected, and which is provided with an elastic supporting member for applying elasticity to the elastic member of the first link member when the plate is moved in a direction;

whereby, when the key top is applied with pressure, the link assembly is retracted and lowered while overcoming an elasticity of the elastic supporting member of the plate, and when the link assembly is further lowered, an elastic resistance of the elastic supporting member is suddenly increased, and thus the elastic member of the first link member is suddenly bent into a bow shape and quickly lowered, thereby affording a click sense to a user and enabling the bent portion of the elastic member to press the FPC to recognize a signal corresponding to the key top.

2. The key switch as set forth in claim 1, in which the plate is slidably moved to push or pull the legs of the first link member connected thereto to raise or lower the link assembly when the keyboard is unfolded or folded or a computer cover is opened or closed.

3. The key switch as set forth in claim 2, in which the computer cover is provided at its rotating shaft with a toothed cam coupled thereto and the plate is provided with a series of holes corresponding to the teeth of the toothed cam, whereby the toothed cam is rotated to move the plate linearly when the cover is opened and closed.

4. The key switch as set forth in claim 2, in which a plate of the keyboard is divided into two half plates, and the two half plates push away from each other to be moved with respect to the frame when the keyboard is folded.

5. The key switch as set forth in claim 1, in which the pivotable connection between the legs of the second link member and the frame is achieved by holes formed at the frame and protrusions formed at the lower end of the legs and inserted into the holes of the frame, the protrusions of the legs being disposed above the plate.

6. The key switch as set forth in claim 1, in which the pivotable connection between the legs of the first link member and the plate is achieved by holes formed at the plate and protrusions formed at the lower end of the legs and inserted into the holes of the first link member, the plate being worked at its portion having the holes such that an axis of the holes is disposed below the plate.

7. The key switch as set forth in claim 1, in which the elastic member of the first link member is provided at its end with a reception portion, and the elastic supporting member of the plate is received in the reception portion of the elastic member.

8. The key switch as set forth in claim 7, in which the elastic supporting member of the plate is bent into an approximately "U" shape, and the bent portion of the elastic supporting member is received into a hole formed at the frame.

9. The key switch as set forth in claim 1, in which the first and second link members are provided at their upper ends with protrusions, each having a slanted face, and the key top is provided at its lower surface with holes to receive the protrusions of one of the first and second link members and grooves to receive the protrusions of the other of the first and second link members.

10. The key switch as set forth in claim 1, in which one of the first and second link members is provided at its both sides with two pairs of holes, each side having a pair of holes, and the other of the first and second link members is provided at its both sides with two pairs of protrusions, each side having a pair of protusions, one of a pair of holes provided at each side being opened upward and the other of the pair of holes being opened downward.

11. The key switch as set forth in claim 10, in which the other hole of the pair of holes is formed into an approximately rectangular shape to limit retraction of the link assembly.

12. The key switch as set forth in claim 1, in which a plurality of link assembly are provided to accommodate an elongated key top other than a common key top.

13. The key switch as set forth in claim 1, in which the elastic supporting member of the plate is bent into an approximately "U" shape, and the bent portion of the elastic supporting member is received into a hole formed at the frame.

* * * * *